United States Patent [19]

Tagliafico

[11] Patent Number: 4,520,332

[45] Date of Patent: May 28, 1985

[54] SOLENOID WITH INTERNALLY LOCATED SWITCH CONTACTS

[75] Inventor: Carlo Tagliafico, Rivoli, Italy

[73] Assignee: Costruzioni Elettromagnetiche Industriali di Tagliafico Carlo, Turin, Italy

[21] Appl. No.: 517,072

[22] Filed: Jul. 25, 1983

[30] Foreign Application Priority Data

Jul. 29, 1982 [IT] Italy ..... 53584/82[U]

[51] Int. Cl.[3] ..... H01H 67/02

[52] U.S. Cl. ..... 335/126; 335/131; 335/268

[58] Field of Search ..... 335/126, 131, 256, 266, 335/268

[56] References Cited

U.S. PATENT DOCUMENTS 2,344,178 3/1944 Sparrow ..... 335/256 X
2,472,553 6/1949 Theunissen ..... 335/256 X
3,425,009 1/1969 Voigt et al. ..... 335/256 X
4,044,322 8/1977 Brown et al. ..... 335/131

*Primary Examiner*—George Harris
*Attorney, Agent, or Firm*—Pearne, Gordon, Sessions, McCoy, Granger & Tilberry

[57] ABSTRACT

An electromagnet comprising an excitation coil wound as a solenoid and having at least two windings which can be selectively supplied; a core fixedly mounted with respect to the coil, a movable core which can move axially with respect to the said coil, and an electric switch which can be actuated by the said movable core selectively to supply the two windings of the coil. The most important characteristic of the electromagnet is the fact that the switch includes a plurality of contact elements mounted fixedly with respect to the coil and the fixed core, and a plurality of movable contact elements carried by a small piston which can move axially with respect to the coil under the action of the said movable core.

7 Claims, 5 Drawing Figures

SOLENOID WITH INTERNALLY LOCATED SWITCH CONTACTS

BACKGROUND OF THE INVENTION

The present invention relates to an electromagnet. In particular, the present invention relates to an electromagnet of the type comprising an excitation coil wound as a solenoid and having at least two windings (driving and holding windings) and which can be selectively energised, a core fixedly mounted with respect to the coil, a movable core which can move axially with respect to the coil, a movable core which can move axially with respect to the said coil, and an electric switch which can be actuated by the movable core to supply the windings of the coil selectively.

Electromagnets of the above specified type are widely used, especially in the industrial field, for transmitting displacement commands both in traction and in thrust with forces of the order of units or tens of kilograms. The use of the switch permits the excitation current in the coil to be reduced at the end of the stroke of the movable coil, that is when the electromagnet is in a condition where it only needs to exert a holding force; this arrangement allows, in particular, considerable forces to be obtained in traction or thrust phase whilst eliminating overheating of the coil in that at the end of the stroke the driving winding is put in series with the so-called holding winding by means of the switch and the current is drastically reduced.

For the purpose of making the use of such electromagnets more versatile, the movable core can be provided at the opposite ends with two shafts which conveniently extend out from the body of the electromagnet and which allow this latter to be used both as a thrust electromagnet as well as a pulling electromagnet. Currently there are no commercially available electromagnets provided with switches for division of the electrical supply to the coil and at the same time able to operate in pull and in push mode. In fact only electromagnets which function in pull mode are known, in which the switch is mounted externally and is substantially constituted by a microswitch of the end-of-stroke type, the operating push-button of which is pressed by the movable core of the electromagnet. This microswitch as well as being bulky, is also of low reliability in that being controlled indirectly by the movable core its electrical contacts open and close slowly causing the occurrence of spark phenomena between these latter and a consequent rapid deterioration. Such electromagnets of known type therefore require constant maintenance and do not lend themselves to being equally used as push and pull electromagnets, the microswitch being head mounted above the movable core.

SUMMARY OF THE INVENTION

The object of the present invention is to provide an electromagnet of the above specified type which overcomes the disadvantages of the known electromagnets listed above.

The said object is achieved with the present invention in that it relates to an electromagnet of the type comprising an excitation coil wound as a solenoid and having at least two windings which can be supplied selectively, a fixed core fixedly mounted with respect to the said coil, a movable core movable axially with respect to said coil and an electrical switch which can be operated by said movable core; first and second shafts extending from opposite axial ends of said movable core, a piston having an axial through hole surrounding said second shaft and axially slidable relative to said fixed core under the action of said movable core, an annular flange on said piston, said switch including a plurality of movable contacts riveted to an annular conductive plate fixed to said flange, and said switch further including a plurality of fixed contacts mounted rigidly with respect to said fixed core.

BRIEF DESCRIPTION OF THE DRAWINGS

For a better understanding of the present invention a non limitative preferred embodiment of the invention will now be described by way of example, with reference to the attached drawings, in which.

DETAILED DESCRIPTION OF THE INVENTION

Figure 1:
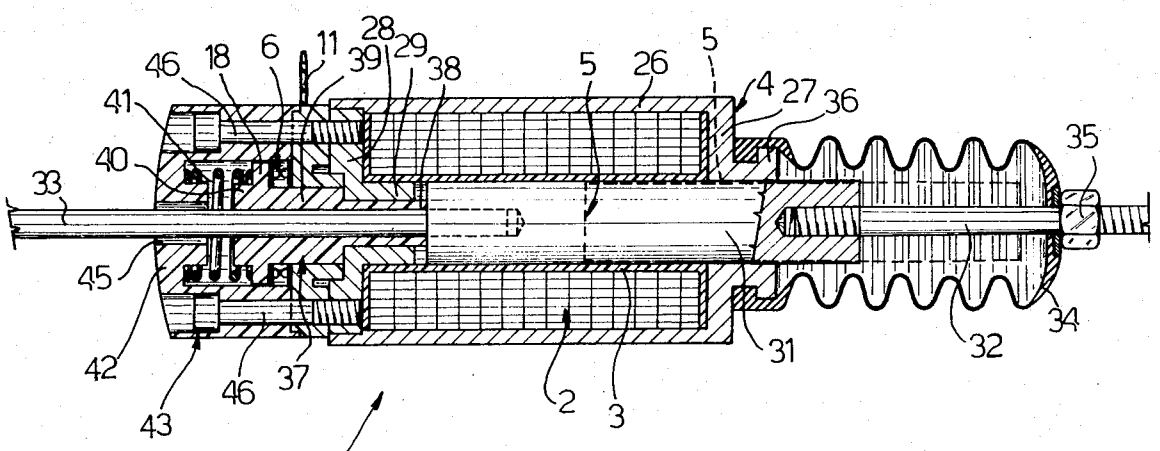
FIG. 1 is a longitudinal, sectional view of an electromagnet formed according to the principles of the present invention.

With particular reference to FIG. 1, an electromagnet is generally indicated 1, comprising an excitation coil 2 wound as a solenoid about a former 3, a core generally indicated 4 and fixedly mounted with respect to the coil 2, a movable core 5 which can move axially with respect to the coil 2, and an electric switch generally indicated 6 and which can be actuated by the movable core 5 when this latter is pressed into contact with the fixed core 6.

Figure 2:
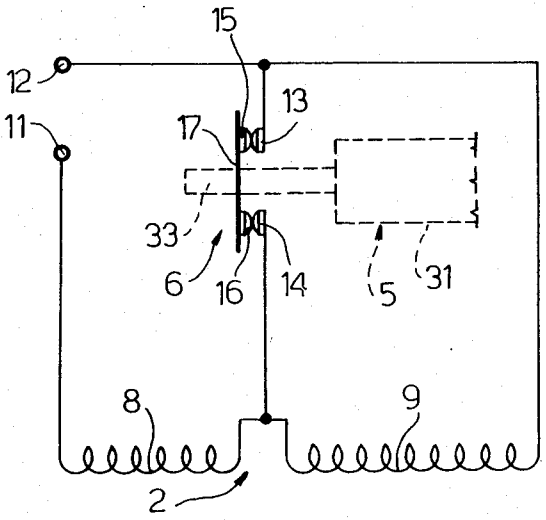
FIG. 2 is an circuit diagram of the electromagnet of FIG. 1.
Figure 4:
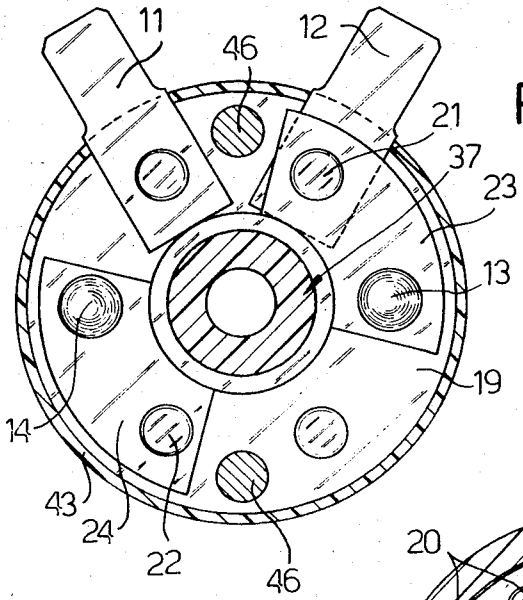
FIGS. 4 and 5 are sectional views taken on the lines IV—IV and V—V of FIG. 3.

From the point of view of the circuit, the electromagnet 1 is illustrated in FIG. 2 in which it can be seen that the coil 2 has two windings, respectively a driving winding 8 and a holding winding 9, the second of which is connected in parallel to the switch 6 and with this latter is connected in series with the first winding 8. Two supply terminals are generally indicated 11 and 12, these being conveniently formed by suitable flat connectors as indicated in FIG. 4.

Figure 5:
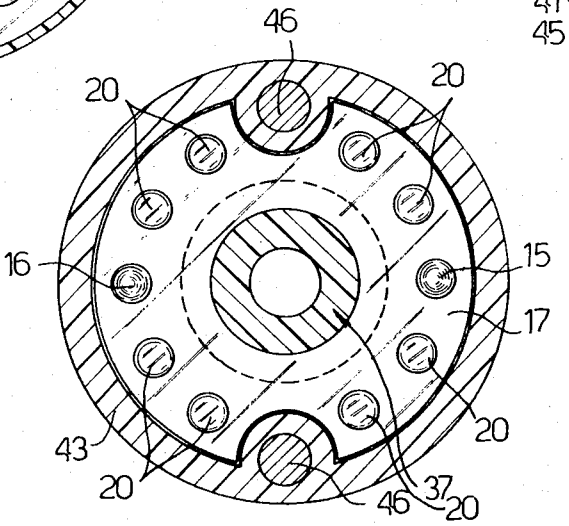

The switch 6 includes a pair of fixed contacts 13, 14 with which cooperate corresponding movable contacts 15, 16 which are connected together by a suitable conductive plate 17. With particular reference to FIGS. 4 and 5, the fixed contacts 13, 14 and movable contacts 15, 16 are conveniently formed by conductive projections suitably riveted onto conductive plates 23, 24 as far as the contacts 13 and 14 are concerned and onto an annular plate 17 as far as the movable contacts 15, 16 are concerned. Both the plate 17 and the plates 23 and 24 are fixed to corresponding support elements 18 and 19 by suitable riveted pins 20, 21, and 22 (see FIGS. 3,4 and 5).

With reference again to FIG. 1, it can be seen that the fixed core 4 is substantially constituted by a cup-shape body 26 having at the lower end a bottom wall 27 through which the movable core 5 slides. On the side opposite the wall 27 the fixed core 4 is closed by means of a disc 28 having a tubular projection 29 extending axially inwardly and operable to act as a stop element for axial displacements of the movable core 5 into the coil 2.

The movable core 5 has a cylindrical intermediate portion 31 which at the opposite ends is connected to threaded shafts 32, 33. The shaft is that which extends on the same side of the bottom wall 27 as the fixed core 4 and in a first part is protected by a bellows 34 having an end coupled to a flange 36 extending outwardly from the bottom wall 27 of the fixed core 4.

The shaft 33 is slidable within an axially pierced piston 37 which in turn slides within the tubular projection 29 of the fixed core 4. By studying in detail the structure of the piston 37 it can be seen that this has, in particular, a first portion 38 slidable, as already mentioned within the tubular projection 29 of the fixed core 4, an intermediate portion 39 which is slidable substantially within the element 19 which supports the fixed contacts of the switch 6, a flange portion already indicated at 18 and constituting the support element for the movable contacts of the switch 6, and a head portion 40. This latter serves the function of guiding and positioning a cylindrical spring 41 which is thus compressed between the flange element 18 and a bottom wall 42 of a cup-shape cover 43 which encloses the switch 6. This cup-shape cover 43 has a through hole 45 with or without bushes to allow the passage of the shaft 33 of the movable core 5 and is connected to the disc 28 of the fixed core 4 by suitable set screws 46.

It is apparent that the fixed core 4 and at least the intermediate portion 31 of the movable core 5 are made of iron only for magnetic purposes, whilst the support element 19, the piston 37 and the cover 43 are conveniently made by a plastics moulding operation.

Figure 3:
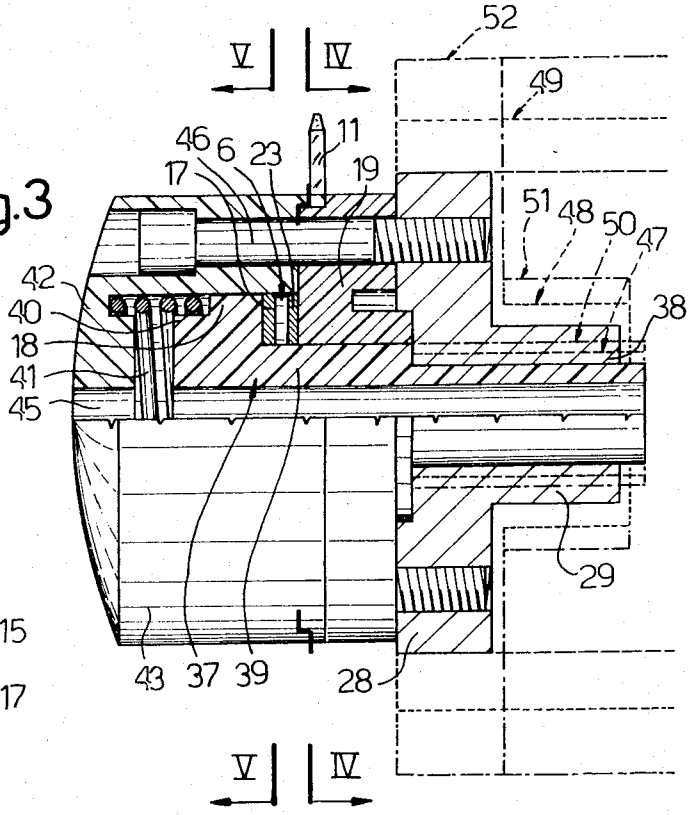
FIG. 3 is a view on an enlarged scale of a detail of FIG. 1.

Finally, with reference to FIG. 3, the outer diameters of the tubular projection 29, the fixed core 4, the portion 38 of the piston 37 and a disc 28 of the fixed core 4 are respectively indicated 47, 48, 49 and 50, 51, 52 for three different dimensions of the electromagnet 1, the upper part of the electromagnet in which the switch 6 is housed remaining the same.

The operation of the electromagnet 1 will now be described with particular reference to FIGS. 1 and 2.

In rest conditions the electromagnet 1 is as indicated in broken outline in FIG. 1: in particular, the switch 6 is closed in that the cylindrical spring 41 presses the piston 37 in such a way as to hold electrically connected together the electrical contacts 13 and 15 and 14 and 16 respectively of this switch.

The supply of an electrical current to the terminals 11 and 12 initially causes the flow of current only in the driving winding 8 of the coil 2 (see FIG. 2) in that the switch 6 short circuits the holding winding 9. The circulation of current in the coil 2 however causes the movable core 5 to be drawn by the fixed core 4 with corresponding axial translation of the core 5 with respect to the coil 2. This translation involves, at the end of the stroke, the axial displacement of the piston 37 with consequent opening of the contacts of the switch 6. Consequently, the electrical current now also flows into the winding 9 which is located in series with the winding 8; the current is now significantly reduced with respect to the current which was flowing only in the winding 8 and is, however, sufficient to exercise a holding action there being no longer an air gap between the fixed and movable cores 4 and 5.

Interruption of the electrical supply current causes the initial conditions to be re-established by means of suitable external biasing springs as far as the movable core 5 is concerned, with consequent closure of the switch 6 due to the spring 41 as described above.

From a study of the characteristics of the electromagnet formed according to principles of the present invention it can be seen how this allows the above specified objects to be achieved.

First of all, it can be utilised both in push and in pull mode above all because of the pierced piston 37 which allows the shaft 33 to project out from the side opposite that from which the shaft 32 projects. Further, given that the action of the switch 6, especially when opening takes place in a particularly rapid manner by means of the movable core 5, sparking between the movable and fixed contacts is reduced to entirely negligible values with consequent significant reduction in wear and also reduction in the necessary maintenance operations. In this respect, it can be seen that making the contacts 13,14,15,16, in silver further improves the durability of the switch 6.

A further important advantage connected with the particular structure of the switch 6 lies in the fact that all of the parts of the electromagnet enclosed within the cup-shape cover 43 can be equally utilised in the construction of electromagnets of any dimensions, as indicated in FIG. 3; in fact, from one case to another it is sufficient to remove a desired layer of the portion 38 of the piston 37 to adapt this latter to the form of the fixed core of the corresponding electromagnet.

Finally, it can be seen that the electromagnet 1 has a particularly robust and compact form and can therefore be used even in those applications in which such requirements are a determining factor.

Finally , it is clear that the electromagnet 1 described above can be modified and varied without by this departing from the scope of the present invention.

For example, an electromagnetic construction including only the shaft 32 could be envisaged, in which case the piston 37 could possibly also not have the axial hole, or vice versa.

I claim:

1. An electromagnet of the type comprising an excitation coil wound as a solenoid and having at least two windings which can be supplied selectively, a fixed core fixedly mounted with respect to said coil, a movable core movable axially with respect to said coil and an electrical switch which can be actuated by said movable core for selectively supplying said two windings, said electromagnet being characterised by first and second shafts extending from opposite axial ends of said movable core;

a piston having an axial through hole surrounding said second shaft and axially slidable relative to said fixed core under the action of said movable core;

an annular flange on said piston;

said switch including a plurality of movable contacts riveted to an annular conductive plate fixed to said flange; and said switch further including a plurality of fixed contacts mounted rigidly with respect to said fixed core.

2. An electromagnet according to claim 1, characterised by the fact that said piston has a tubular portion which is slidable within said fixed core.

3. An electromagnet according to claim 1, characterised by the fact that said flange is subjected to a resilient force in an axial direction generated by a corresponding spring tending to maintain said fixed contact elements and movable contact elements in contact with one another.

4. An electromagnet according to claim 3, characterised by the fact that said spring is of a cylindrical type and is compressed between said flange and a cover which encloses said switch and which is anchored to said fixed core.

5. An electromagnet according to claim 4, characterised by the fact that said cover is of cup-shape and has a through hole through which said second shaft projects outwardly.

6. An electromagnet according to claim 1, characterised by the fact that said annular conductive plate is substantially circular.

7. An electromagnet according to claim 6, characterised by the fact that a longitudinal guide prevents rotation between said movable and fixed contacts.

* * * * *